US007196327B2

(12) United States Patent
Thomson et al.

(10) Patent No.: US 7,196,327 B2
(45) Date of Patent: Mar. 27, 2007

(54) QUADRUPOLE MASS SPECTROMETER WITH SPATIAL DISPERSION

(75) Inventors: Bruce Thomson, Toronto (CA); Alexandre V. Loboda, Toronto (CA)

(73) Assignee: MDS, Inc., Concord (CA)

( * ) Notice: Subject to any disclaimer, the term of this patent is extended or adjusted under 35 U.S.C. 154(b) by 604 days.

(21) Appl. No.: 10/643,092

(22) Filed: Aug. 19, 2003

(65) Prior Publication Data

US 2005/0056778 A1 Mar. 17, 2005

Related U.S. Application Data

(60) Provisional application No. 60/404,168, filed on Aug. 19, 2002.

(51) Int. Cl.
*H01J 49/42* (2006.01)

(52) U.S. Cl. ..... 250/292; 250/281; 250/282

(58) Field of Classification Search ..... 250/292, 250/287, 281, 282, 290, 291, 396 R
See application file for complete search history.

(56) References Cited

U.S. PATENT DOCUMENTS 5,420,425 A 5/1995 Bier et al.
5,576,540 A 11/1996 Jolliffe
5,847,386 A * 12/1998 Thomson et al. ..... 250/288
6,093,929 A * 7/2000 Javahery et al. ..... 250/282
6,744,043 B2 * 6/2004 Loboda ..... 250/287

FOREIGN PATENT DOCUMENTS

WO WO 97 07530 A 2/1997

OTHER PUBLICATIONS

Internatioanl Search Report—Application No. PCT/CA03/01247 filed Aug. 19, 2003.

* cited by examiner

*Primary Examiner*—Kiet T. Nguyen
(74) *Attorney, Agent, or Firm*—Bereskin & Parr

(57) ABSTRACT

A mass analyzer for use in a mass spectrometry system comprises an elongate rod set. The rod set has first and second ends and an inscribed circle within the rod set. The radius of the rod set varies from one end of the rod set to the other, so that ions of different mass to charge ratios will become unstable at different locations along the rod set. This characteristic can then be used to cause ejection of ions at different locations along the rod set, in a mass dependent manner. Detectors placed linearly along the rod set can then be used to detect ions and determine the mass of the ions from their ejection locations.

20 Claims, 2 Drawing Sheets

QUADRUPOLE MASS SPECTROMETER WITH SPATIAL DISPERSION

BACKGROUND OF THE INVENTION

A conventional quadrupole mass spectrometer consists of four parallel electrodes to which RF and DC voltages are applied. The electrode profiles may be either hyperbolic (which produces ideal quadrupolar in between the rods) or round (which with the correct spacing produces a close approximation to ideal fields). Quadrupole mass spectrometers are widely used in commercial mass spectrometer systems for trace chemical analysis.

The quadrupole operate as mass filter when a beam of ions passes along the axis by allowing only a selected mass range (or more correctly, m/e where m is the mass and e is the charge on the ion) to be transmitted. Only ions which are stable can be transmitted, the condition for stability being defined by the non-dimensional parameters a and q:

$$q=4eV/(r_0^2\omega^2 m)$$

$$a=2eU/(r_0^2\omega^2 m)$$

where U is the DC voltage, V is the RF voltage, $r_0$ is the radius of the inscribed circle between the rods, ω is the angular frequency of the RF voltage (radians/s), m is the mass of the ion and e is the charge. Ions which have a and q values outside the limits of stability increase their amplitude of oscillation and are lost to the rods.

Typically a mass spectrum is obtained by sweeping the RF and DC voltages (in a fixed ratio) through a range of values so that ions of increasing mass pass through the same a–q value of stability and are sequentially transmitted.

It will be noted that the same effect can be achieved by sweeping the frequency, although there is a square relationship between mass and frequency.

SUMMARY OF THE PRESENT INVENTION

The present invention is based on the realization that, mathematically, a third option to obtain a mass spectrum would be to sweep $r_0$, the radius of the circle between the electrodes. However, to vary the radius $r_0$ and to maintain this constant and uniform along a rod set is mechanically non-trivial. Accordingly, the present invention arranges the geometry so that $r_0$ decreases along the flight path of the ions and the rods are fixed in position. Then a fixed voltage and frequency applied to the electrodes can be selected so that each ion as it traverses the axis is subjected to a gradually increasing value of q (and a). If the slope of the scan line (in the frame of reference of the ion passing through the device) is not too great, each ion will remain stable until it reaches the edge of the stability region, where it will become unstable and strike a rod. Since each ion will become unstable at the same value of q (and a), with V, U and ω fixed, and $r_0$ a function of distance z, the point of instability for each ion will be dispersed in space. That is if $r_0=r_0(z)$, then for each mass, q=q(z), and a particular value of q will be a function of both m and z:

$$q=f(z,m)$$

If we operate with a=0, and consider that the point of instability is q=0.908 (the boundary of stability), then the position of instability for each mass is:

$$0.908=4eV/r_0^2\omega^2 m \qquad [1]$$

If $r_0$ is a linear function of distance, so that $r_0=r_{0\,max}-kz$, and we establish a minimum mass to be transmitted, then we can express m in terms of the value of $r_0$ at which it is just unstable:

$$m = 4eV/(0.908\ r_0^2\omega^2) \qquad [2]$$

$$= 4eV/\left(0.908\omega^2(r_{0\max}-kz)^2\right)$$

This shows the relationship between m (mass) and distance (or position) at which mass m becomes unstable.

In the present invention, one or more of the rods may contain a slot through which ions, which become unstable are ejected. An array detector (position-sensitive detector) is aligned with the slot in order to detect the position as well as the intensity of the ions, which exit through the slot. The position of the ion signal along the array detector can be mathematically correlated with the mass of the ion.

To cover a mass range of 30–3000 in 20 cm requires that $r_0$ change by 10× over a 20 cm length. If $r_0$ is a linear function of distance (constant taper) then m is a non-linear function of distance (as shown above), with the high masses being squeezed into the last few cm.

BRIEF DESCRIPTION OF THE DRAWING FIGURES

For a better understanding of the present invention and to show more clearly how it may be carried into effect, reference will now be made, by way of example to the accompanying drawings, which show a preferred embodiment of the present invention and in which.

DETAILED DESCRIPTION OF THE INVENTION

Figure 1:
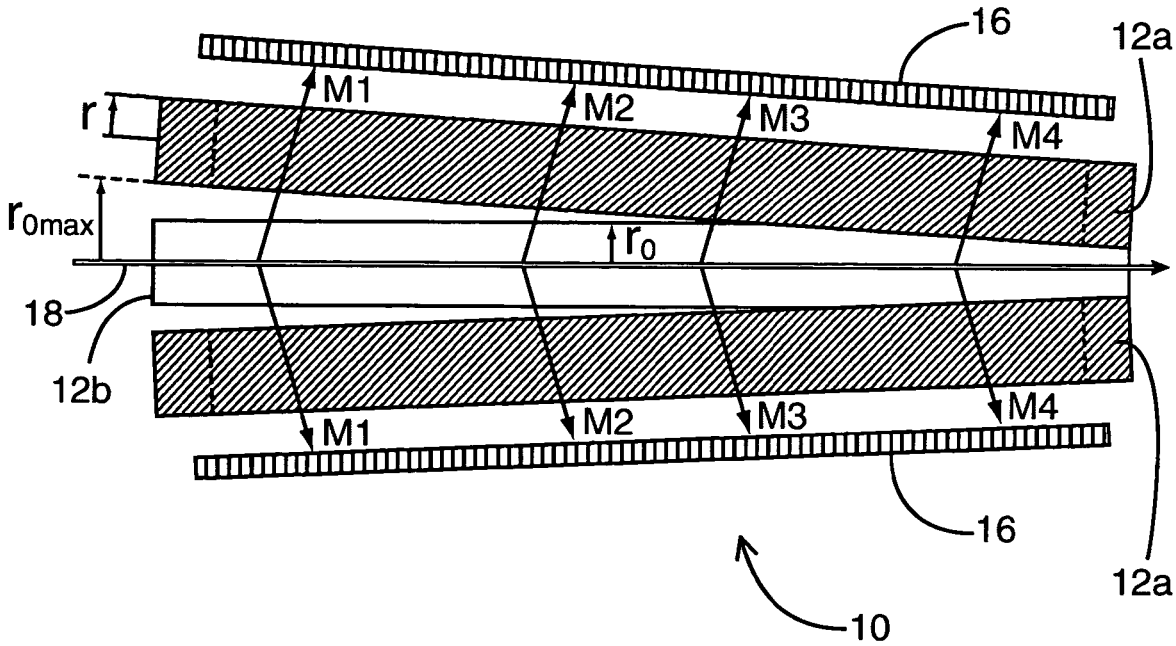
FIG. 1 is a sectional view through a rod set with detectors in accordance with the present invention.

FIG. 1 shows a mass analyzer 10 in accordance with the present invention. The mass analyzer 10 comprises a quadrupole rod set comprising a first pair of opposed rods 12*a*and a second pair of opposed rods 12*b* (both shown in FIG. 2). As shown, the rods 12*a*, 12*b* all have the same and constant radius, and are mounted so that the inscribed circle between the rods varies from a maximum of $r_{0max}$ at the inlet to the rod set on the left hand side of FIG. 1 to a minimum at the other end of the rod set on the right hand side of FIG. 1. Thus, the rods 12*a*, 12*b* are configured in accordance with equation [2]. Thus, the position in which different masses become unstable is determined by the inverse square relationship between the mass and the radius of the inscribed circle.

As shown, the rods 12*a* are provided with slots 14, to enable ions to pass to detectors 16. The rods 12*b* are conventional, solid round rods. Details of the excitation scheme to cause ions to be ejected towards the detectors 16 are given below. An ion stream is indicated at 18.

As indicated above in equations [1] and [2], due to the inverse square relationship between the mass and the radius, the provision of a simple, uniform taper in the inscribed radius from one end of the rod set to the other, as in FIG. 1, gives a non-linear relationship between mass and distance along the rod set. The present invention also realizes that,to provide a mass scale, which is linear in distance, $r_0$ can be made according to the following relationship:

$$r_0=(1/(r_{0\,max}+kz))^{1/2} \quad [3]$$

Substituting [3] into [2] above gives a linear relationship between mass (m) and position (z):

$$m=4eV(r_{0\,max}+kz)/0.908\omega^2 \quad [4]$$

This then gives a linear relationship between mass and position along the rod set, so that the position of the ion along the detector array thus indicates its mass value.

It will be appreciated that where this relationship applies, then simple rods of constant diameter cannot be used. The external profile of the rods would then be required to have some, generally, parabolic profile. To achieve this, it will generally be necessary to provide rods that are machined or manufactured to have a radius that varies along the length of the rods. For this purpose, it may be preferable to arrange the rods so that their axes are all parallel to the axis of the device, and the radii of the rods then vary to give the relationship indicated above for $r_0$.

It is also known in this art that, in general, it is desirable to have a constant ratio between the inscribed radius, $r_0$ and the radius r of each rod, i.e., so that $r/r_0$ equals a constant. Again, this could be achieved by suitable machining of the rods, but, in general, this is expected to lead to more complex rod profiles.

A further consideration is that, if it is necessary to manufacture rods to relatively complex shapes, having radii that vary along the length of the rods, then relatively complex and expensive numerically controlled machining techniques will likely be required. It should be held in mind that, in this field, extremely tight tolerances are required in order to obtain high performance and good resolution. Accordingly, for some applications, it may prove beneficial to provide rods as electrodes with a hyperbolic profile, varying to meet the requirements of the varying $r_0$ as indicated above. In such cases, the additional cost for providing the hyperbolic profile may not be too great, given that plain cylindrical rods cannot in any event be used, and a hyperbolic profile may give enhanced performance. Accordingly, in the claims where reference is made to "rods" this should be construed to include the possibility of electrodes which do not have a purely cylindrical shape, electrodes which do not necessarily have a purely circular cross section and electrodes with a hyperbolic profile.

It will be understood that the analysis in equations given above is based on the standard analysis of fields within a rod set. More specifically, this, inherently, assumes that the fields are constant and uniform in the axial direction. This assumption should be true where the degree of taper along the rod set, whatever the exact profile of the rods, is relatively slight. Where it is desired to analyze a relatively large range of ions, then it may be necessary to provide a relatively steep taper to the rods along the length of the rod set. In such a case, the fields will necessarily vary significantly in the axial direction, and this assumption may not hold completely. Additionally, where, for example, a rod profile is chosen in accordance with equation [3], this may give a taper to the rods that is relatively large at one section of the rod set, but not for the whole rod set, again leading to distortion of the fields, so that again, the standard analysis, based on the assumption that fields are constant in the axial direction, may not be completely accurate.

When ions become unstable, they do so toward any of the four rods, depending on the initial entrance conditions of the ions. It is an advantage to make the ions unstable in one plane only, so that a detector need only be placed behind one or two of the rods. This can be achieved by applying a supplementary AC dipole voltage across the pair of rods 12*a*. The frequency is chosen to be in resonance with the secular motion of the ions at a particular value of q. Since q for each mass is a function of distance down the axis, the ions will be excited at a unique position and leave the device. As above, this provides a signal of mass vs. distance along the axis. By applying a low frequency AC, appropriate to a relatively low q value, the mass range is extended by the ratio of 0.908/q. The two detectors 16 are used to increase the signal, one behind each of the two opposite rods to which the excitation voltage is applied. This technique of adding a supplementary AC voltage is commonly used in ion trap mass spectrometers to increase the mass range.

Another method of forcing ions to become unstable toward one set of rods, is to apply a small quadrupolar (resolving) DC voltage between the rods 12*a*, 12*b*. This makes the ions unstable in the X direction at a q-value, which is slightly less than 0.908, ensuring that the ions will be ejected toward one set of rods only. Note that operating the above mass spectrometer at $a\neq 0$ will result in some limitation of the accessible mass range, because when $a\neq 0$ the heaviest ions may be unstable at the entrance of the device. The higher the value of a, the narrower the mass range of the ions that can be simultaneously transmitted through the device. In practice, finding an appropriate value of a is a matter of balancing requirements of mass range, resolution, and detection efficiency.

In another mode of operation, ions are stored in front of the device, and then injected in a pulse. If the ions enter at constant velocity, the light ions will reach their point of instability first, followed by the heavier ions; light ions will thus be first in time to leave the device. If the ions enter at constant energy, the heavier ions will be slower, and so the time dispersion will be increased. The combination of time and spatial dispersion will help in improving the mass resolution.

The mass resolution achievable with this invention depends on a) the spatial resolution of detector; and b) the assumption that all ions of the same mass are ejected at the same position in space. In practice, there will be a range of position over which ions are ejected, leading to some limitations on the mass resolution.

Consider the Effects of Various Parameters on the Operating Characteristics:

a) Ion Energy Spread:

The mass resolution can be defined as $\Delta m/\Delta z$. Since each ion requires a certain time $\tau$ to reach the detector once it becomes unstable, any spread in ion energy is reflected in a spread in spatial position along the detector. For example, an ion of mass $m_1$ and kinetic energy $E_1$ has velocity $v_1=(2E_1/m_1)^{1/2}$. If another ion of the same mass $m_1$ has a kinetic energy $E_2$, and hence a velocity $v_2=(2E_2/m_1)^{1/2}$, then the two ions will strike the detector at two positions $z_1$ and $z_2$. The difference between the positions is:

$$z_1-z_2=(v_1-v_2)\tau \quad [5]$$

where $\tau$ is the time required for the ion to be ejected, i.e. the time required to move from the center of the rod set to the detector:

$$\tau = d/V$$

$$= d/(2E/m_1)^{1/2}$$

Substituting for $\tau$, $v_1$, and $v_2$ in [5] above:

$$z_1 - z_2 = d[(E_1 - E_2)/E]^{1/2}$$

Here d may be approximately 10 mm, $E_1-E_2$ may be about 1 eV, and E, the energy with which ions are ejected from the quadrupole, may be approximately 100 eV. Thus $\Delta z$ may be of the order of 1 mm for a 1 eV energy spread. To obtain a spatial dispersion of less than 0.1 mm, an energy spread of less than 0.01 eV is required.

b) Ion Energy

The position at which the ion exits is energy dependent, but this is not a significant concern as long as the energy is not mass dependent.

c) Mass range: The total mass range available(the ratio of the lightest and heaviest ions that can be deleted)=$(r_{0max}/r_{0min})^2$. If $r_{0max}$=12 mm, and $r_{0min}$=1.2 mm, then mass range is 100 fold i.e. from 30–3000 or 10–1000 etc.

e) Mass resolution: Mass resolution can be expressed in terms of amu/mm. From [2] above, $m=4eV/q(r_0)^2\omega^2$. If $r_0$ is linear with distance (i.e. $r_0=r_{0max}-kz$), then it can be shown by differentiation than $\Delta m/\Delta z=2\ mk/(r_0)$. For example if k=0.1, $\Delta m/\Delta z=2*1000(0.1)/2=100$ amu/mm at m/z 1000 if m/z 1000 is ejected at $r_0$=2 mm. This means a spatial resolution of 0.01 mm is needed to separate m/z 1000 from m/z 1001. At m/z 100, assuming this mass is ejected at 6.32 mm, $\Delta m/\Delta z=2*100(0.1)/6.32=2.8$ amu/mm.

In the above examples, it is assumed that a wide mass range (covering a factor of 100-fold) is required. This requires that the diameter at the entrance be 10× larger than that at the exit. Such a significant taper to the rod set will introduce axial fields and distortions to the ideal two-dimensional quadrupolar field, which may significantly limit the achievable mass resolution and transmission.

Therefore another aspect of the present invention is to design the mass analyzer so that it transmits only a narrow mass range. For example, if it is only required to cover a factor of 2 in mass range (from m/z 50 to m/z 100, or from m/z 500 to m/z 1000), then the required ratio of entrance and exit diameters is only a factor of 1.44. The taper required to provide this (over a typical length of 20 cm) will introduce less distortions, and allow better resolution and sensitivity to be achieved. By reducing the overall mass range, for a given rod length, the sensitivity measured as amu/mm can be increased significantly. A wide mass range can then be covered by using a series of fixed voltages in sequence to cover sequential ranges, which can then be combined in the data system.

One example, which can benefit from a narrow mass range is that of isotope ratio measurement. This requires the intensities of two or more adjacent or closely spaced ions to be measured with high precision. The fact that ions of different m/z are measured simultaneously at different points along the rod set axis provides a significant advantage in this application, since it provides improved precision over that achievable with a scanning instrument. If only a narrow mass range (e.g. 10% of the low mass value) need be covered, then only a small taper is required, and the distortions to the quadrupole field will be insignificant.

In order to achieve good mass resolution, it is important that all ions of the same m/z become unstable at the same point in space, and that they are ejected toward the rods and detector as quickly as possible. Certain methods have been designed for two- and three-dimensional ion traps which use a voltage scan to perform mass-selective ejection, in addition small higher order field components are added in order to improve the speed at which ions become unstable once they reach a point of instability. These higher order field components can be generated by specific electrode shapes and positions, or by adding additional electrodes between the rods, or by the explicit addition of other low-amplitude electrical components to the RF waveform. Similar advantage may be gained in the described invention by adding such additional fields in order to make the ions leave the device more quickly. Appropriate experiments and theoretical modeling can be used to define the optimum configurations.

More recently, there have been proposals to modify quadrupole rod sets, so that they generate other fields usually only present in higher order rod sets, e.g. usually only generated by hexapole, octopole, etc. rod sets. Thus, it has been found that if some deliberate displacement of one or more rods from the perfect quadrupole configuration is provided, then this will generate higher order field components. This can also be used to generate non-linear fields.

These higher order and/or non-linear fields can be generated in a number of ways. For example it is not necessary for all the rods to have identical cross-sections. The cross-sections can vary in terms of the exact shape and/or in terms of the size of the cross-section, between different rods. It is also possible that, for any one rod, the cross-sectional size or shape and/or the shape of the cross-section could vary along the length of the rod.

It is believed that this technique should be applicable to the present invention, where the mass analyzer 10 has tapered rods. Selection of suitable additional field components should enable narrower peaks to be provided and better mass selection.

Figure 2:
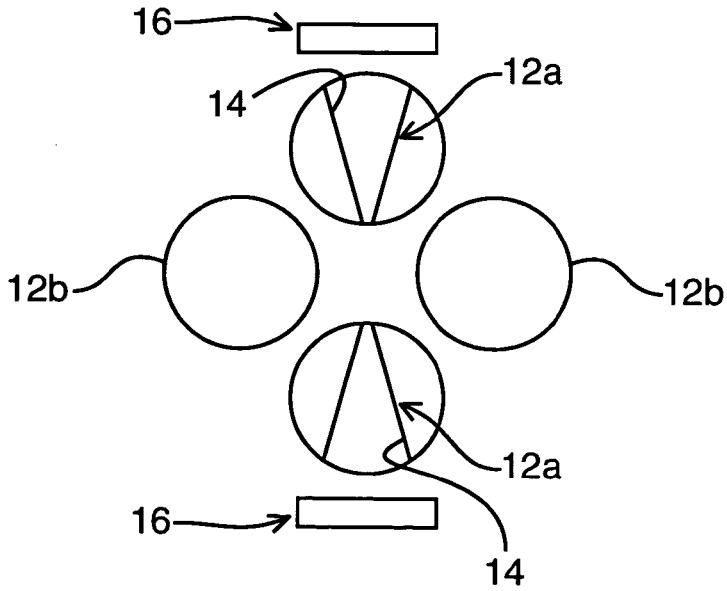
FIG. 2 is a sectional view across the axis and adjacent one end of the rod set of FIG. 1.

Additionally, the provision of other field components may improve efficiency and promote ejection in a desired direction, e.g. in the vertical plane so that the ejected ions are detected by the detectors 16 as shown in FIG. 2.

A further possibility is to provide some mechanism or device upstream of the mass analyzer 10 that shapes the ion beam 18, or causes the ion beam 18 to be introduced at a desired location, e.g. off center from the axis of the analyzer 10. This could be achieved by DC deflector plates or the like upstream from the analyzer 10. These DC deflector plates could be "synchronized" with the RF field. It should be possible to carry out theoretical calculations working back from the analyzer 10 to determine the desired characteristics of the ion beam 18 when it enters the analyzer 10, for any particular intended analysis.

When ions are initially focused on the axis for injection, it is noted that the ion beam is not a thin beam of ions but a beam that has a spatial distribution with a cross sectional area spread from the axis. This spatial distribution becomes amplified even further as the ions traverse along the length. This could lead to reduced resolution since, for a given m/z, some ions will become unstable and be ejected sooner than other ions, due to their differing locations relative to the axis. By "steering" the beam of ions so that they are injected off centre from the axis, the ions will become unstable sooner (and are ejected sooner) with the result that the effect of the initial spatial distribution is less significant.

By off centring the ion beam to the axis, it would be necessary to "recalibrate" the relation between amu as a function of length (mm). This is done by insuring that the timing of the ion beam, off centre position, and RF fields are controlled in a way so they are constants or of a known value. For example, it may be necessary to time the ion beam so the ions are injected in to the ion guide at a specific timing of the RF. That is, the ion beam injection is pulsed to "synchronize" with the phase of the RF so that each group of ions are injected during the same time period. In addition, or in the alternative, the position at which the ions are injected relative to the center axis can be changed as a function of the RF signal.

The detector for this invention must detect both the intensity of the ion signal, and the position along the axis (z coordinate) at which the ions are received. Various types of array detectors can be used, and are well known in the field of mass spectrometry. Such array detectors are used with certain magnetic sector mass spectrometers, which provide spatial dispersion at the exit plane. In one type of detector, a charge-coupled array in a rectangular configuration can be used. The individual collectors in this array can be a small as 10 micrometers along one side. Allowing for a width of 5 mm and a length of 20 cm, a total of 500×20,000 individual detectors or pixels would be available. Each separate collector can detect as little as 100 ions. After collecting the ion current for a fraction of a second (for example, 100 ms), the contents of each collector can be read out, providing a measurement of position and intensity, corresponding to a mass spectrum.

Additionally, a microchannel plate could be positioned between the slots and the detector so that the intensity of the ions are first amplified before being detected by the array detector. Depending on the channel density of the microchannel plate, each distinct segment of the array detector could be coupled to one or more distinct channels of the plate.

Another type of array detector is that in which the position of an individual ion which strikes the surface can be measured by determining the time delay for the signal to reach sensors along the side of the device.

Figure 3:
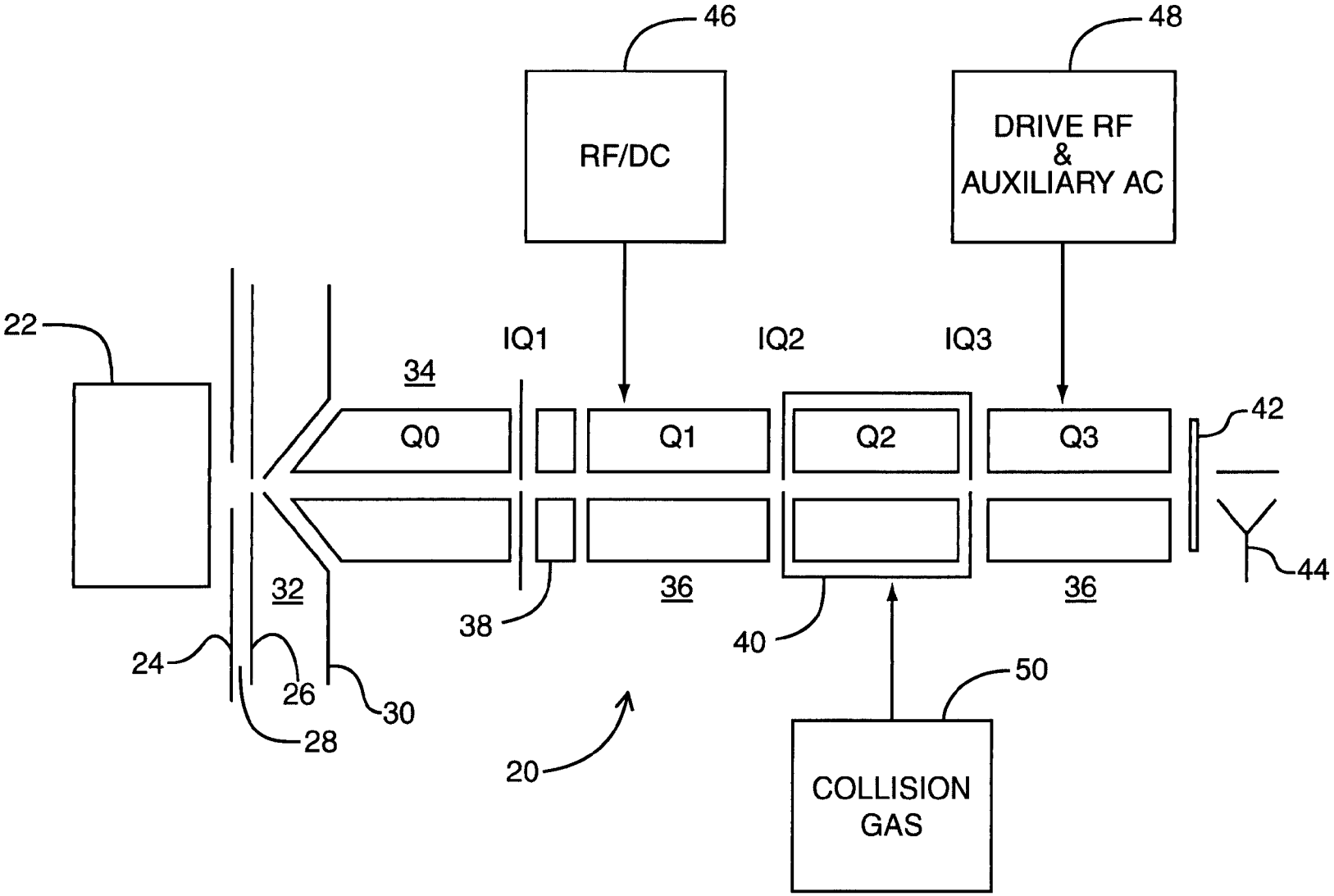
FIG. 3 is a schematic view of a conventional triple quadrupole mass spectrometer, to indicate incorporation of the present invention therein.

Reference will now be made to FIG. 3, where there is shown a conventional triple quadrupole mass spectrometer apparatus generally designated by reference 20, which can incorporate a mass analyzer 10 of the present invention, as detailed below. An ion source 22, for example an electrospray ion source, generates ions directed towards a curtain plate 24. Behind the curtain plate 24, there is an orifice plate 26, defining an orifice, in known manner.

A curtain chamber 28 is formed between the curtain plate 24 and the orifice plate 26, and a flow of curtain gas reduces the flow of unwanted neutrals into the analyzing sections of the mass spectrometer.

Following the orifice plate 26, there is a skimmer plate 30. An intermediate pressure chamber 32 is defined between the orifice plate 26 and the skimmer plate 30 and the pressure in this chamber is typically of the order of 2 Torr.

Ions pass through the skimmer plate 30 into the first chamber of the mass spectrometer, indicated at 34. A quadrupole rod set Q0 is provided in this chamber 34, for collecting and focusing ions. This chamber 34 serves to extract further remains of the solvent from the ion stream, and typically operates under a pressure of 7 mTorr. It provides an interface into the analyzing sections of the mass spectrometer.

A first interquad barrier or lens IQ1 separates the chamber 34 from the main mass spectrometer chamber 36 and has an aperture for ions. Adjacent the interquad barrier IQ1, there is a short "stubbies" rod set, or Brubaker lens 38. A first mass resolving quadrupole rod set Q1 is provided in the chamber 36 for mass selection of a precursor ion. Following the rod set Q1, there is a collision cell 40 containing a second quadrupole rod set Q2, and following the collision cell 40, there is a third quadrupole rod set Q3 for effecting a second mass analysis step.

The final or third quadrupole rod set Q3 is located in the main quadrupole chamber 36 and subjected to the pressure therein typically $1\times10^{-5}$ Torr. As indicated, the second quadrupole rod set Q2 is contained within an enclosure forming the collision cell 40, so that it can be maintained at a higher pressure; in known manner, this pressure is analyte dependent and could be 5 mTorr. Interquad barriers or lens IQ2 and IQ3 are provided at either end of the enclosure of the collision cell of 40.

Ions leaving Q3 pass through an exit lens 42 to a detector 44. It will be understood by those skilled in the art that the representation of FIG. 3 is schematic, and various additional elements would be provided to complete the apparatus. For example, a variety of power supplies are required for delivering AC and DC voltages to different elements of the apparatus. In addition, a pumping arrangement or scheme is required to maintain the pressures at the desired levels mentioned.

As indicated, a power supply 46 is provided for supplying RF and DC resolving voltages to the first quadrupole rod set Q1. Similarly, a second power supply 48 is provided for supplying drive RF and auxiliary AC voltages to the third quadrupole rod set Q3, for scanning ions axially out of the rod set Q3. A collision gas is supplied, as indicated at 50, to the collision cell 30, for maintaining the desired pressure therein, and an RF supply would also be connected to Q2 within the collision cell 40.

The invention can be used as a component, such as that shown in FIG. 3 in a tandem mass spectrometer. For example, it can be used as the second mass spectrometer, replacing Q3, in the triple quadrupole instrument 20, providing continuous and efficient measurement of fragment ions from a collision cell. Other fragmentation methods, (such as surface induced fragmentation, photo induced fragmentation, electron capture dissociation) can be used.

The invention can also be used in a configuration where an ion mobility device is followed by a collision cell, with the mass spectra of the fragment ions being measured by the described spatial dispersion quadrupole 10 (such an instrument is disclosed in U.S. patent application Ser. No. 10/004,800, the contends of which are hereby incorporated by reference). This has particular advantage because the separation time of an ion mobility device is too fast for a normal scanning mass spectrometer to allow a full scan of each mobility peak to be recorded. In the invention described, there are no scan-speed limitations because mass spectra are recorded continuously and simultaneously.

In summary, the advantage of this invention is that mass spectra are obtained without scanning, so that sensitivity is improved by 10× to 100× over a scanning instrument (depending on the mass range).

The invention claimed is:

1. A mass analyzer for analyzing ions, having an ion transmission device comprising:

a) a set of elongated rods, having a first end and a second end, said set of elongated rods positioned along an axis, defining an inscribed circle between the rods, said inscribed circle having a radius $r_0$, wherein the radius at the first end and at the second end is different;

b) means for applying a RF voltage to said elongated rods; and c) at least one rod including at least one opening through which at least some of said ions are ejected along said rod, the mass of an ion is determined by the location where the ion is ejected along said at least one rod.

2. A mass analyzer in claim 1, wherein the set of elongated rods comprises at least one pair of opposite rods.

3. A mass analyzer in claim 1, wherein the set of elongated rods have a quadrupole configuration.

4. A mass analyzer in claim 3, further comprising means for applying a DC offset voltage applied to said rods.

5. A mass analyzer as claimed in claim 3, wherein the rods include at least one rod displaced from an exact quadrupole configuration, to cause the generation of higher order field components.

6. A mass analyzer in claim 1, wherein the opening is a slot.

7. A mass analyzer in claim 1, further comprising a detector positioned along said at least one rod to detect the intensity and position of the ions that are ejected through said at least one opening.

8. A mass analyzer in claim 4 or 7, further comprising means for applying a supplementary AC voltage across one of the pairs of rods.

9. A mass analyzer in claim 8, further comprising two array detectors each positioned approximately behind one of the elongated rods to which the supplementary AC voltage is applied.

10. A mass analyzer in claim 7, wherein said detector is an array detector.

11. A mass spectrometer system having more than one mass analyzer, comprising a mass analyzer according to claim 1.

12. A mass analyzer in claim 11 having a means for storing ions for pulse injection into said mass analyzer.

13. A mass analyzer in claim 11 having a means for collision induced dissociation for injecting fragmented ions into said mass analyzer.

14. A mass analyzer in claim 11 having a means for ion mobility separation for injecting ions into said mass analyzer.

15. A method mass analyzing ions, said method comprising:

a) providing a set of elongated rods, having a first end and a second end, and located round an axis defining an inscribed circle between the rods with a radius $r_0$, and varying the radius $r_0$ along the length of the set of elongated rods;

b) admitting ions into said first end of said rod set;

c) transmitting ions through the set of elongated rods, at least one rod includes at least one opening; and d) ejecting at least some of said ions through said at least one opening, the mass of an ion is determined by the location where the ion is ejected along said at least one rod.

16. A method according to claim 15 wherein, in step (b), ions are admitted from a collision cell.

17. A method according to claim 16 wherein, in step (b), an ion mobility device precedes the collision cell.

18. A method according to claim 15 wherein, in step (b), ions are admitted from an ion mobility device.

19. A method as claimed in claim 15, including in step (b), admitting ions into the set of elongate rods with desired characteristics of position, direction and velocity, relative to the axis, to promote detection of ions of interest.

20. A method according to claim 15 further comprising detecting the intensity and position of the ions that are ejected through said at least one opening.

* * * * *